US009624078B2

(12) United States Patent
Cozza

(10) Patent No.: US 9,624,078 B2
(45) Date of Patent: Apr. 18, 2017

(54) APPARATUS FOR LIFTING DISPLAY CASES

(76) Inventor: Frank Charles Cozza, Lakeside, CA (US)

( * ) Notice: Subject to any disclaimer, the term of this patent is extended or adjusted under 35 U.S.C. 154(b) by 1271 days.

(21) Appl. No.: 11/508,412

(22) Filed: Aug. 22, 2006

(65) Prior Publication Data

US 2007/0059138 A1 Mar. 15, 2007

Related U.S. Application Data

(60) Provisional application No. 60/710,424, filed on Aug. 22, 2005.

(51) Int. Cl.
*B66F 9/18* (2006.01)
*B66F 5/00* (2006.01)

(52) U.S. Cl.
CPC ..... *B66F 5/00* (2013.01)

(58) Field of Classification Search
CPC ..... B62B 2203/10; B62B 1/14; B66F 9/06
USPC ..... 414/490, 607, 608, 446, 458, 785
See application file for complete search history.

(56) References Cited

U.S. PATENT DOCUMENTS

| | | | | | |
|---|---|---|---|---|---|
| 2,675,139 | A * | 4/1954 | Mercier | B66F 9/12 | 414/607 |
| 3,023,919 | A * | 3/1962 | Hobson | 414/607 |
| 3,085,656 | A * | 4/1963 | Hopfeld | 187/231 |
| 3,325,023 | A * | 6/1967 | Coleman | B66F 9/12 | 414/724 |
| 3,907,138 | A * | 9/1975 | Rhodes | 414/448 |
| 5,489,183 | A * | 2/1996 | Malden et al. | 414/490 |
| 5,975,826 | A * | 11/1999 | Scholder | 414/444 |
| 6,059,512 | A * | 5/2000 | Kielinski | 414/490 |
| 6,062,802 | A * | 5/2000 | Aenchbacher | 414/490 |
| 6,095,537 | A * | 8/2000 | Cozza et al. | 280/79.11 |
| 6,457,727 | B1 * | 10/2002 | Tolly | 280/47.28 |
| 6,517,307 | B1 * | 2/2003 | Marino | 414/607 |
| 6,530,740 | B2 * | 3/2003 | Kim | B62B 1/002 | 180/251 |
| 6,929,443 | B1 * | 8/2005 | Nellis | 414/449 |
| 7,645,108 | B2 * | 1/2010 | Benko | 414/490 |
| 2005/0169736 | A1 * | 8/2005 | Decky | 414/490 |

* cited by examiner

*Primary Examiner* — Michael McCullough
*Assistant Examiner* — Mark C. Hageman
(74) *Attorney, Agent, or Firm* — Donn K. Harms

(57) ABSTRACT

A device for lifting the legs of a display case in a store or office which is supported on legs. The device features a a "U" shaped frame, having a horizontal portion and two substantially vertical side portions extending from the horizontal portion. A face plate is engageable with a leg lifting component. A jack situated on top of the horizontal portion provides the lift for the leg lifting component. The leg lifting components may be adapted to any type of leg and engaged with the device allowing one lifting apparatus to engage any type of leg on any display case it is adapted to engage. The jack can be user supplied or included with the device as a unit. An optional skate for the lifted leg can also be provided.

11 Claims, 3 Drawing Sheets

APPARATUS FOR LIFTING DISPLAY CASES

This application claims the benefit of U.S. Provisional Application Ser. No. 60/710,424, filed on Aug. 22, 2005.

BACKGROUND OF THE INVENTION

1. Field of the Invention

The present invention relates to relocation of display cases used in stores. More particularly it relates to a lifting apparatus which is adaptable for a plurality of configurations to lift different types of display cases and allow easy insertion of dollies under the legs of such large storage and display structures. Such gondolas and display cases are employed generally as retail store display cases, file cabinets, shelving, and other such components which use a system of small legs engaged to a support structure to support the display case, and the stored or displayed goods above a floor surface.

2. Prior Art

Storage and display shelving and cases are an everyday fact of life in a modern society. Because floor space in most retail stores, storage warehouses, and office buildings is at such a premium, the display and storage of merchandise, records, and an infinite number of other items have progressed upward. In order to conserve floor space in retail situations and provide a better viewing and access to products, shelving is commonly employed to hold products. Such shelving is generally arranged to form isles for customers to traverse through adjacent shelf structures. The shelves in this configuration give the customers a much better view of the products as well as holding much more inventory than could be done if shelving were not used.

In warehouses where goods and products are stored for distribution or shipping, shelving is also employed to increase the storage capacity in the given floor space and to organize the inventory. Offices also use shelving to hold records and display goods as well as file cabinets to organize and hold volumes of files, thereby concentrating storage in a small but heavy area.

All such shelving and cabinets, whether in retail stores, warehouses, and offices, must be structurally able to support the load intended, making it heavy. Such shelving is even heavier when fully loaded with the product or item being stored on its shelves.

A vexing problem of such shelving by nature of its need to support a load is the weight and ungainly nature of the shelving especially when loaded with products for sale. The shelves loaded with products are inherently top heavy and easily tip over. A variety of jacks and dollies have been introduced in the past, most of which pertain to the lifting of such cabinets which have support legs with an adjustable leveling foot extending therefrom to level the shelves. However most conventional products lack an adaptable display engaging component to lift the legs of different types of gondolas and display racks and concurrently allow easy insertion of a dolly or skate thereunder while lifted. This is especially the case where the dolly to be employed under the leg is not provided in a matched system to work with the lifting apparatus or jack.

The ungainliness of the shelving and the lack of lifting devices adaptable to the task becomes a vexing task when the moving of shelves is required during the remodeling or renovation of retail stores such as grocery stores, drug stores and the like. During such a remodeling process, it is often necessary to move large display cases, conventionally known as gondolas, which hold everything from tooth paste to canned soup. Moving generally requires repositioning the shelves or gondolas from one part of the store to another. Such display cases or gondolas are large, heavy, and have extending shelves which hold and display a very large number of small products for sale, making them top heavy and unstable. With the cost of labor and time involved, removing and replacing the products each time the display case is to be relocated can be especially expensive and can also play havoc with the short time schedules allotted for the remodeling process to minimize lost sales. As such, a device for lifting and a system providing the ability to move display cases and other heavy storage devices, while fully loaded with products or other stored items, is highly desirable.

In some instances shorter and smaller loaded display cases can be relocated with any suitable lifting apparatus, such as conventional elongated fork lifts or floor jacks, by placing them on conventional flat surfaced dollies for transport. However, most display cases are too long, or, as is normal in retail sales establishments, the cases are connected together in long sets of fifty feet or more spaced apart by narrow aisles. Consequently, transport by floor jack or flat dollies is not an option. Further, because storage and display properties of such display cases generally yield shelves very close to opposing shelves on the other side of the display aisle, frequently there is insufficient room in the aisle between adjacent display cases for entry of a fork lift or large flat surfaced dolly.

Additionally, while small dollies have been manufactured to engage with portions of the underlying support structure of the shelves, the ever widening variety and construction of such support structures has made it hard to employ small dollies which will accommodate the width and legs of different types of supports. Ideally, a dolly should be provided that works in conjunction with the lifting apparatus, but the lifting apparatus should be adaptable to work with a plurality of different dollies or skates so it may be employed in locations with existing dollies.

As such, there is a continuing unmet need for an improved lifting device and system adapted to lift the legs of gondolas and display cases in supermarkets and stores. Such a device should be easily adaptable to lift a wide variety of legs of different dimensions by a swift change of an engaging mechanism. Such a display lifting device should also provide for easy inline insertion of a dolly or skate once the gondola, shelf, or filing cabinet is lifted, and easy subsequent lifting off the dolly or skate once the cabinet has reached its intended position.

SUMMARY OF THE INVENTION

The device and method herein disclosed and described achieves the above-mentioned goals through the provision of an adaptive jack operated lifting system that employs or is adapted to engage a hydraulic jack in an elevated mount upon a "U" shaped base to elevate a display case. Keyholes on a mounting plate allow for easy and fast removable engagement of differently configured forks or brackets to engage different types of leg bases used on different types of gondolas and display cases. This is especially important due to the many manufacturers of such displays and storage racks using proprietary legs in addition to some industry standard versions being employed.

The lifting device employs a generally "U" shaped base with preferably a hydraulic jack positioned in the center on a cross bar. Two upright members at the distal ends of the cross bar are engaged to wheels to allow the device to roll.

A keyholed mounting plate, slidably engaged upon vertical risers which are engaged traverse to the cross bar, translates between the upright members under the cross bar. A fork or engagement component correctly configured for engagement of the intended legs is removably engageable to the mounting plate using a projection adapted to engage in the keyholes formed in the plate.

The means for jacking in this case a hydraulic jack, positioned on the crossbar between the vertical risers slidably engaged to the plate, is then activated to lift, and as the jack lifts, it engages with a member extending from the mounting plate and will translate the mounting plate upward, thereby elevating the engaged leg of the gondola or rack off the floor. A skate, which in a particularly preferred mode would be provided with the lifting apparatus, may then be easily slid under the cross bar between the two upright members and placed under the leg. Of course other skates or small dollies can be employed so long as they will fit under the crossbar and between the upright members. This unique display lifting device eliminates the need to elevate the leg at an angle with a crowbar or forklift tip and then try and maneuver some type of skate or dolly under the leg from another angle. It also provides for an infinite number of forks or engagement components to engage an infinite number of configurations of the legs holding up gondolas and display cases.

Accordingly, it is an object of the invention to provide a device for lifting display cases, gondolas, storage racks, file cabinets and the like by engaging the legs supporting them.

Another object of this invention is to provide such a device jack that provides one jack operated lifting mechanism that is adaptable to an infinite number of leg engagement components to allow the device to be customized to the individual rack to be lifted by changing the leg engagement component.

A further object of this invention is to provide such a display case jack that may be manufactured as a single lifting mechanism that is adaptable to a wide variety of display cases.

Yet another object of this invention is the provision of a display case leg lifting mechanism that can be engaged with a conventional small hydraulic jack.

Still another object of this invention is to provide such a display case leg lifting device which allows for easy insertion of a small skate or dolly under an elevated leg directly from the back or user operable side through a formed space under an elevated beam.

These together with other objects and advantages which become subsequently apparent reside in the details of the construction and operation as more fully hereinafter described and claimed, reference being had to the accompanying drawings forming a part thereof, wherein like numerals refer to like parts throughout.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is e capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

BRIEF DESCRIPTION OF DRAWING FIGURES

Figure 1:
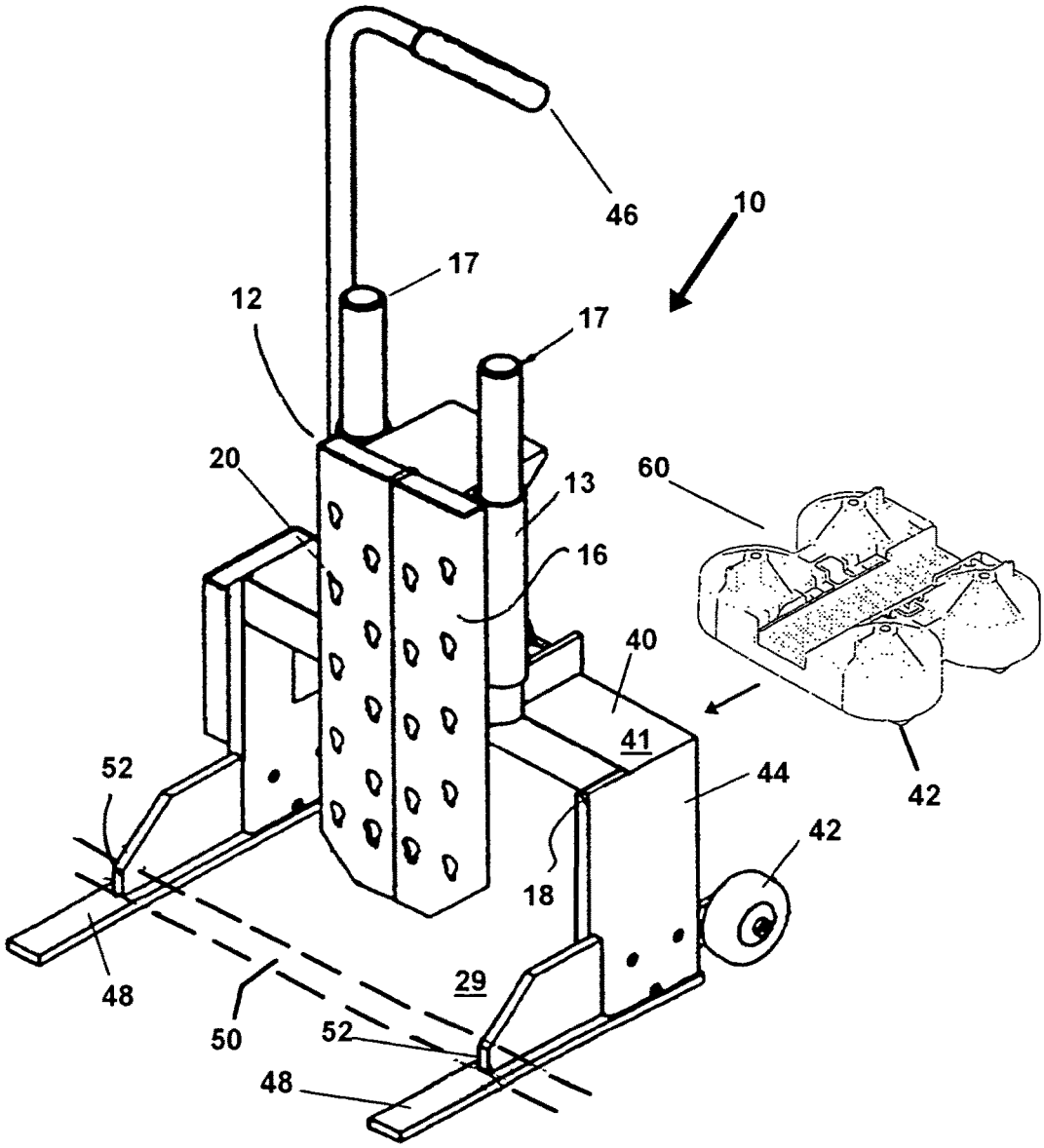
FIG. 1 depicts the front view of the device showing the keyholed plate where forks or properly adapted leg engagement components interchangeably mounted and a skate positioned for insertion through the passage of the device.
Figure 2:
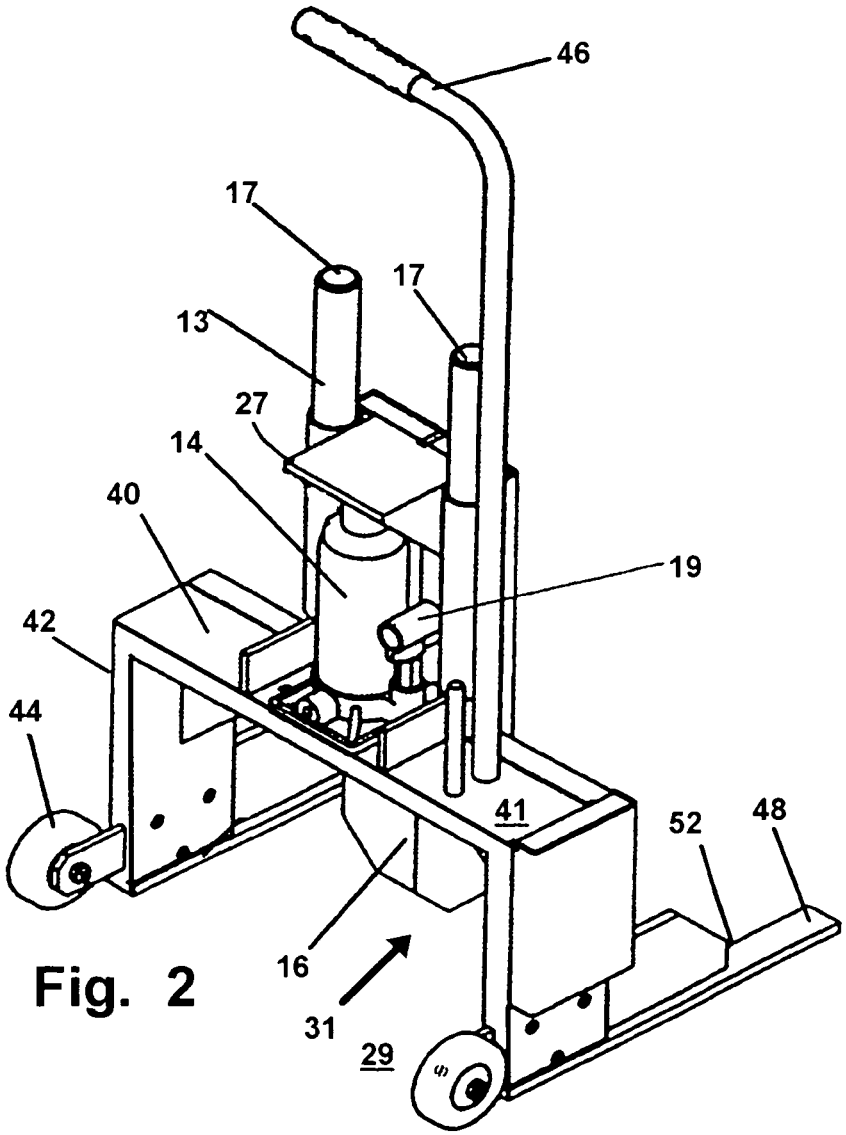
FIG. 2 depicts a rear view showing the device with a jack mounted on the cross bar of the U shaped base and vertical risers slidably engaged with the rack for translation thereon and a hydraulic jack.
Figure 3:
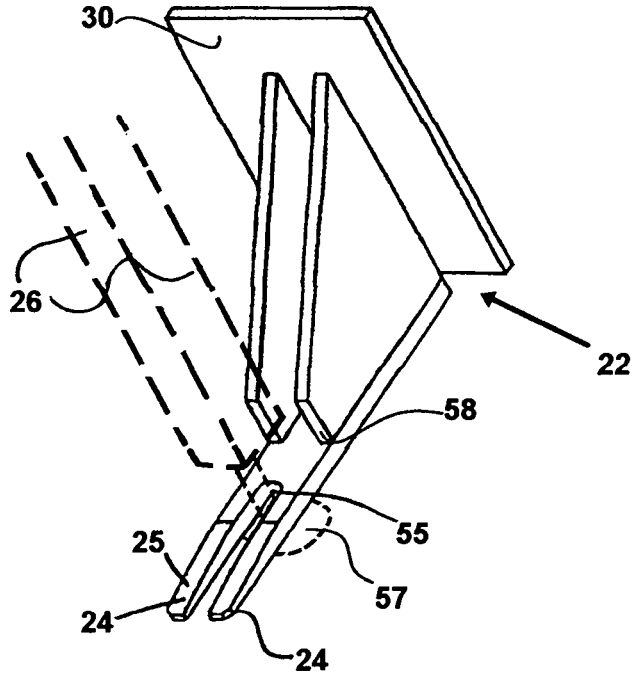
FIG. 3 shows one type of leg engagement component particularly adapted for display case legs with adjustable pads extending from threaded adjusting pins.
Figure 4:
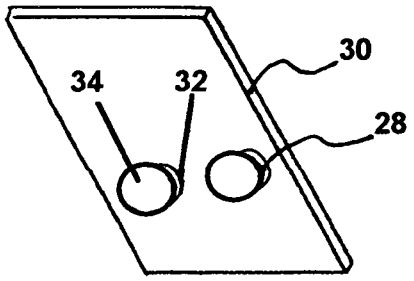
FIG. 4, shows a rear view of the leg engagement component and the projecting pins adapted to engage the keyhole apertures of the plate.

The device 10 as shown in FIGS. 1-4 features a lifting mechanism or component 12 which is adapted to engage a hydraulic jack 14 or mechanical jack as a means for mechanical advantage for lifting a translatable mounting plate 16 which is in a slidable engagement in an elevated mount upon a "U" shaped base 18. The mounting plate 16 has a plurality of apertures communicating through it formed in a keyhole 20 shape narrower at a bottom edge than at a top portion of the aperture. These keyholes 20 proved a removable means of engagement of differently configured leg engagement components 22 which as depicted in FIG. 3 in a particularly preferred mode of the device 10 have forks 24 with a taper 25 on distal ends to allow the engagement component 22 to slide under the legs 26 used to support the frames of many gondolas and display cases and file cabinets. Of course other means of removable engagement of the leg engagement component to the mounting plate can be employed all that would occur to those skilled in the art are anticipated. However the disclosed keyhole and pin system is especially preferred as it provides a very stable mount that is held in place by the force of gravity on the display case and consequently the heavier the case, the better the engagement.

The ability to quickly change the leg engagement component 22 to one adapted to lift the intended leg 26 of the intended gondola or shelf is particularly important since they vary widely in configurations. This adaptability of the lifting component is provided by means for removable engagement of the base 30 leg engagement component 22 shown in the current preferred mode as engaging pins 28 on the rear of the component base 30 which may be engaged into the keyholes 20 at their wider portion and allowing them to drop into a mount at the narrow portion. The pins have a neck portion 32 which is narrower than the planar distal end 34 such that the planar distal end 34 holds the base 30 into engagement on the plate 16.

The device 10 has a generally "U" shaped base 18 with preferably a hydraulic jack 14 positioned in the center on a cross bar 40 held elevated by two upright members 42 engaged to the two ends of the cross bar 40. Wheels 44 on the upright members 42 allow the device 10 to roll when tiled by handle 46 or pushed while supported on the skids 48 which project from the front wall of the upright members 42. These skids 48 provide a means to elevate the fascia or kickplates 50 commonly employed on the aisle side of most commercial gondolas or shelves. Sliding the device 10 with the skids 48 leading, will cause the kickplates to bow letting the skids 48 slide under the kickplates 50 until they reach a stop 52 located between the distal end of the skids 48 and the base 18 to which they are engaged. This provides a means to space the faceplate 16 a distance from the leg 26 of the shelf or gondola, such that the leg engagement component 22 will have its distal end in the proper position to lift the leg 26. Consequently all the leg engagement components 22 are manufactured such that when the kickplate 40 abuts the stop 52, the lifting component 22 is operatively positioned under the leg 26 to lift it. In the case of the depicted component 22 of FIG. 3 for example the two forks 24 would slide under the legs 26 and surround the adjustment pin 55 of the foot 57 for an especially secure mount. A second stop 58 is also provided in the preferred mode of the device 10 on the lifting component 22 to abut the side edge of the intended leg 26 to further register the lifting component in its engagement with the intended leg 26.

The keyholed mounting plate 16 is translatabley engaged upon two vertical risers 17 which are engaged perpendicular to the upper side 41 of the cross bar 40. This mounting plate 16 translates between the upright member 42 projecting down from the cross bar 40 toward the ground from its lowest position where the lifting component 22 would be adjacent to or slide on the support surface or floor 29, to an elevated position where the leg 26 being lifted is elevated such that a conventional wheeled support used for display cases such as a dolly or skate 60 with wheels 40 can be inserted under the bottom of the leg 26.

The means for lifting with mechanical advantage, which as shown is the jack 14 is best positioned on the top surface of the crossbar 40, between the vertical risers 17 which are slidably engaged to the plate 12 with collars 13 or other means for slidable engagement. When activated to lift by handle engagement 19 or other means of activation, the extending end of the jack 12 engages with a horizontal member 27 extending from or in operative communication with the mounting plate 16 such that extending the jack 12 will translate the mounting plate upward toward the elevated position thereby elevating the engaged leg of the gondola or rack off the floor.

The skate 60, which in a particularly preferred mode would be provided with the device 10 as a kit, may then be easily slid under the leg 26 of the shelf using the pathway 31 formed under the cross bar 40, between the two upright members 42. This is particularly important since it eliminates trying to angle the dolly or skate into place and allows for a straight or normal path of the skate 60 under the leg 26. Since the lifting component is easily engaged to the plate 16 there is provided means for engagement of an infinite number of lifting components 22 each adapted for registered engagement with a leg 26 once the device 10 abuts the kickplate 50 or second stop 58 on the leg 26 or both.

In a kit, the device 10 would be supplied with a number of different lifting components 22 adapted to different brands or styles of shelves, gondola, filing cabinets and the like. The user can choose the correct lifting component 22 for the task from the kit and engage it to the plate 16 whereafter the device 10 would be slid forward on the wheels 44 to allow the skids 48 to bow the kickplate 50 until encountering the stop 52. The correctly configured lifting component 22 will be in registered engagement with the legs 26 which is raised by engaging the jack 12 to lift. Once in the elevated position, the skate 60 would be slid directly through the path 31 between the uprights 42 and to a position under the leg 26. The process is repeated until all the legs 26 of the shelf or gondola are elevated on skates 60 wherein the gondola or shelf may be rolled to a new position. The process is reversed to lower the shelf in its new position.

While all of the fundamental characteristics and features of the invention have been shown and described herein, with reference to particular embodiments thereof, a latitude of modification, various changes and substitutions are intended in the foregoing disclosure and it will be apparent that in some instance, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. An apparatus for lifting legs supporting a display case upon a support surface, comprising:

a frame, said frame having a cross bar, said cross bar having an upper surface opposite a lower surface;

a pair of side members, a first of said pair of side members in an engagement with a first end of said cross bar, and a second of said pair of side members in an engagement with a second end of said cross bar;

said cross bar held elevated above said support surface with said lower surface facing said support surface, by said pair of side members extending from respective said engagements said cross bar, to respective distal ends of said pair of side members positioned upon said support surface;

a pair of vertical risers each extending away from said top surface of said cross bar to respective distal ends, from respective first ends of said vertical risers positioned on said top surface of said cross bar;

a face plate having a front surface and a rear surface, said face plate in a sliding engagement upon said vertical risers;

a jack positioned upon said cross bar, said jack connected with said face plate;

said face plate in said sliding engagement translatable in a direction toward said distal ends of said vertical risers, by actuation of said jack;

a lifting component having a first end in a removable engagement with said front surface of said face plate;

said lifting component having an engagement end opposite said first end, said engagement end formed by a single member having a pair of forks at a distal end with a gap therebetween;

said lifting component positionable to a removable engagement with a said leg supporting said display, by positioning an upper surface of both of said pair of forks underneath and in contact with a lower surface of said leg on opposing sides of a foot extending from said lower surface, and concurrently positioning said foot extending from said lower surface of said leg, within said gap and extending below a lower surface of said pair of forks, opposite said upper surface;

said leg positionable to an elevated position while in said removable engagement with said lifting component, by actuation of said jack to translate said face plate in said direction toward said distal ends of said vertical risers;

a pathway defined by the area above said support surface and below said lower surface of cross bar, and in between respective facing side surfaces of said pair of side members; and said pathway adapted for traverse of a wheeled support to pass therethrough in a direction running from said rear surface of said faceplate toward said engagement end of said lifting component, whereby said wheeled support is positionable under said foot extending from said lower surface of said leg while said leg is in said elevated position;

wherein said upper surface of both of said pair of forks tapers downward toward distal ends of each of said pair of forks.

2. The apparatus for lifting legs supporting a display case upon a support surface of claim 1, wherein said sliding engagement of said face plate upon said vertical risers comprises:

said face plate having a pair of collars engaged therewith;

one each of said pair of collars in a respective sliding engagement with a respective one of said vertical risers.

3. The apparatus for lifting legs supporting a display case upon a support surface of claim 2 additionally comprising:

a wheeled support having a top surface configured to engage a distal end of said foot excluding from said leg and support said leg thereon when lowered from said elevated position.

4. The apparatus for lifting legs supporting a display case upon a support surface of claim 3 additionally comprising:

a first skid engaged at a first end with a front face of one of said pair of side members and extending to a distal end;

a second skid engaged at a first end with a front surface of the other of said pair of side members;

said first skid and said second skid adapted to slide between said support surface and a lower edge of a kickplate engaged with said display case, and elevate said kickplate a distance above said support surface to form a gap between said kickplate and support surface for passage of said lifting component therethrough during positioning thereof to a said removable engagement.

5. The apparatus for lifting legs supporting a display case upon a support surface of claim 2 additionally comprising:

a first skid engaged at a first end with a front face of one of said pair of side members and extending to a distal end;

a second skid engaged at a first end with a front surface of the other of said pair of side members;

said first skid and said second skid adapted to slide between said support surface and a lower edge of a kickplate engaged with said display case, and elevate said kickplate a distance above said support surface to form a gap between said kickplate and support surface for passage of said lifting component therethrough during positioning thereof to a said removable engagement.

6. The apparatus for lifting legs supporting a display case upon a support surface of claim 1, wherein said removable engagement of said first end of said lifting component to said front of said face plate comprises:

a plurality of keyhole shaped apertures communicating through said face plate;

each of said keyhole shaped apertures having a first opening at a first end and a second opening at second end and a slot communicating therebetween, said first opening sized larger than said second opening;

at least one pin having a first end extending from an attachment with said first end of said lifting component, said pin having a distal end;

said distal end sized smaller than said first opening and larger than said second opening; and whereby said distal end of said pin is insertable into any said first opening of any of said plurality of apertures and slidable toward said second opening to a retained position.

7. The apparatus for lifting legs supporting a display case upon a support surface of claim 6 additionally comprising:

a wheeled support having a top surface configured to engage a distal end of said foot extending from said leg and support said leg thereon when lowered from said elevated position.

8. The apparatus for lifting legs supporting a display case upon a support surface of claim 6 additionally comprising:

a first skid engaged at a first end with a front face of one of said pair of side members and extending to a distal end;

a second skid engaged at a first end with a front surface of the other of said pair of side members;

said first skid and said second skid adapted to slide between said support surface and a lower edge of a kickplate engaged with said display case, and elevate said kickplate a distance above said support surface to form a gap between said kickplate and support surface for passage of said lifting component therethrough during positioning thereof to a said removable engagement.

9. The apparatus for lifting legs supporting a display case upon a support surface of claim 1, additionally comprising:

a wheeled support having a top surface configured to engage a distal end of said foot extending from said leg and support said leg thereon when lowered from said elevated position.

10. The apparatus for lifting legs supporting a display case upon a support surface of claim 9 additionally comprising:

a first skid engaged at a first end with a front face of one of said pair of side members and extending to a distal end;

a second skid engaged at a first end with a front surface of the other of said pair of side members;

said first skid and said second skid adapted to slide between said support surface and a lower edge of a kickplate engaged with said display case, and elevate said kickplate a distance above said support surface to form a gap between said kickplate and support surface for passage of said lifting component therethrough during positioning thereof to a said removable engagement.

11. The apparatus for lifting legs supporting a display case upon a support surface of claim 1, additionally comprising:

a first skid engaged at a first end with a front face of one of said pair of side members and extending to a distal end;

a second skid engaged at a first end with a front surface of the other of said pair of side members;

said first skid and said second skid adapted to slide between said support surface and a lower edge of a kickplate engaged with said display case, and elevate said kickplate a distance above said support surface to form a gap between said kickplate and support surface for passage of said lifting component therethrough during positioning thereof to a said removable engagement.

* * * * *